US011118594B2

(12) United States Patent
Griffin

(10) Patent No.: US 11,118,594 B2
(45) Date of Patent: Sep. 14, 2021

(54) SEAL APPARATUS FOR A TURBOMACHINE CASING

(71) Applicant: Dresser-Rand Company, Olean, NY (US)

(72) Inventor: Daniel J. Griffin, Enfield, CT (US)

(73) Assignee: DRESSER-RAND COMPANY, Olean, NY (US)

( * ) Notice: Subject to any disclaimer, the term of this patent is extended or adjusted under 35 U.S.C. 154(b) by 44 days.

(21) Appl. No.: 16/611,269

(22) PCT Filed: May 2, 2018

(86) PCT No.: PCT/US2018/030551

§ 371 (c)(1),
(2) Date: Nov. 6, 2019

(87) PCT Pub. No.: WO2018/212990

PCT Pub. Date: Nov. 22, 2018

(65) Prior Publication Data

US 2020/0166046 A1 May 28, 2020

Related U.S. Application Data

(60) Provisional application No. 62/506,787, filed on May 16, 2017.

(51) Int. Cl.
*F04D 29/08* (2006.01)
*F01D 1/06* (2006.01)
*F04D 29/42* (2006.01)

(52) U.S. Cl.
CPC ..... *F04D 29/083* (2013.01); *F04D 29/4206* (2013.01)

(58) Field of Classification Search
CPC ..... F04D 29/08; F04D 29/083; F04D 29/086; F04D 29/4206; F01D 1/06; F01D 1/063; F01D 5/063; F16J 15/3268; F16J 15/3232
(Continued)

(56) References Cited

U.S. PATENT DOCUMENTS 4,909,705 A * 3/1990 Katsura ..... F04D 29/086 415/170.1
5,056,799 A * 10/1991 Takenaka ..... F16J 15/3232 277/562

(Continued)

FOREIGN PATENT DOCUMENTS

JP 2012177338 A 9/2012

OTHER PUBLICATIONS

PCT International Search Report and Written Opinion dated Jul. 20, 2018 corresponding to PCT Application PCT/US2018/030551 filed May 2, 2018.

*Primary Examiner* — Thai Ba Trieu

(57) ABSTRACT

A seal apparatus for a casing of a turbomachine. The seal apparatus may include an annular body having first and second annular body portions and an appendage. The second annular body portion may extend axially from the first annular body portion and may have an outer annular surface radially offset from an outer annular surface of the first annular body portion. The appendage may extend axially from the first annular body portion and may have an outer annular surface and an inner annular surface. The inner annular surface of the appendage and the outer annular surface of the second annular body portion may define an annular cavity therebetween, and at least a portion of the appendage may be configured to be displaced radially outward in order to maintain contact with first and second inner cylindrical surfaces of the casing during radial expansion of the casing.

13 Claims, 3 Drawing Sheets

(58) Field of Classification Search
USPC ..... 415/173.1, 170.1; 277/562, 569
See application file for complete search history.

(56) References Cited

U.S. PATENT DOCUMENTS

| | | | | |
|---|---|---|---|---|
| 5,087,172 | A | 2/1992 | Ferri et al. | |
| 5,207,560 | A * | 5/1993 | Urban | F04D 1/063 415/173.1 |
| 5,456,577 | A * | 10/1995 | O'Sullivan | F04D 29/086 415/199.2 |
| 5,846,052 | A * | 12/1998 | Kameda | F04D 29/086 415/182.1 |
| 6,279,914 | B1 * | 8/2001 | Yamanaka | F16J 15/3268 277/569 |
| 9,556,879 | B2 | 1/2017 | Shinohara et al. | |
| 9,702,371 | B2 * | 7/2017 | Meuter | F04D 29/086 |
| 10,584,710 | B2 * | 3/2020 | Welschinger | F04D 29/086 |
| 2008/0031732 | A1 | 2/2008 | Peer et al. | |
| 2014/0178182 | A1 * | 6/2014 | Huth | F04D 29/083 415/170.1 |
| 2015/0159669 | A1 | 6/2015 | Meuter et al. | |
| 2016/0090990 | A1 | 3/2016 | Zacharias | |

* cited by examiner

SEAL APPARATUS FOR A TURBOMACHINE CASING

PRIORITY CLAIM

This application claims the benefit under 35 U.S.C. § 119(e) of U.S. Provisional Application No. 62/506,787 filed on May 16, 2017 and entitled SEAL APPARATUS FOR A TURBOMACHINE CASING, which is incorporated herein by reference in its entirety and to which this application claims the benefit of priority.

BACKGROUND

1. Technical Field

Aspect of the present invention relate to a seal apparatus for a turbomachine casing, and more particularly, to a seal apparatus having an annular body that includes first and second annular body portions and an appendage that extends axially from the first annular body portion wherein an inner annular surface of the appendage and an outer annular surface of the second annular body define an annular cavity wherein at least a portion of the appendage may be configured to be displaced radially outward in order to maintain contact with first and second inner cylindrical surfaces of the casing during radial expansion of the casing.

2. Description of Related Art

Turbomachines such as centrifugal compressors generally include compressor components (e.g., impellers) mounted on a rotary shaft and disposed within a casing. The rotary shaft typically extends through an opening at one or both ends of the casing. Accordingly, a plug-like body, commonly referred to as a compressor head, may be inserted into the opening(s) to close and seal the casing opening. The compressor head may be axially retained in the compressor by a plurality of shear keys.

To provide a seal between the compressor head and the casing, typically one or more O-rings may be disposed between an outer surface of the compressor head and an inner surface of the casing. In high pressure compressors (e.g., 10,000 psi (68.9 MPa)), it has been found that as pressure is increased, the casing grows radially outward while the compressor head grows little or none. The resulting increasing radial gap between the compressor head and casing may cause the seal provided by the O-rings to fail by extrusion through the radial gap.

What is needed, therefore, is a seal apparatus for a turbomachine casing that may accommodate for the growth of the turbomachine casing in high pressure applications while maintain a seal at the casing opening.

SUMMARY

Embodiments of this disclosure may provide a seal apparatus for a casing of a turbomachine. The seal apparatus may include an annular body having a center axis and defining a central opening extending along the center axis. The annular body may further include a first annular body portion, a second annular body portion, and an appendage. The first annular body portion may include a first annular sidewall, a second annular sidewall axially opposing the first annular sidewall, and an outer annular surface extending between the first annular sidewall and the second annular sidewall. The second annular body portion may extend axially from the first annular body portion and may have an outer annular surface radially offset from the outer annular surface of the first annular body portion. The appendage may extend axially from the first annular body portion and may have an outer annular surface and an inner annular surface. The inner annular surface of the appendage and the outer annular surface of the second annular body portion may define an annular cavity therebetween, and at least a portion of the appendage may be configured to be displaced radially outward in order to maintain contact with a first inner cylindrical surface of the casing and a second inner cylindrical surface of the casing during radial expansion of the casing.

Embodiments of this disclosure may further provide a turbomachine. The turbomachine may include a casing, a rotary shaft, one or more rotating components coupled to the rotary shaft, and a seal apparatus. The casing may include a center axis, a first end and a second end axially opposing the first end, and a plurality of inner cylindrical surfaces radially offset from one another and defining a first portion and a second portion of a central bore. The second portion of the central bore may extend from the first portion of the central bore to the second end of the casing. The one or more rotating components may be disposed within the first portion of the central bore and may be configured to pressurize a process fluid. The seal apparatus may be disposed within the central bore and configured to substantially reduce or prevent a process fluid pressurized in the first portion from exiting the second end of the casing. The seal apparatus may include a first annular body portion, a second annular body portion, and an appendage. The first annular body portion may be disposed within the second portion of the central bore. The second annular body portion may extend axially from the first annular body portion and may have an outer annular surface. The appendage may extend axially from the first annular body portion and may have an outer annular surface and an inner annular surface. The inner annular surface of the appendage and the outer annular surface of the second annular body portion may define an annular cavity therebetween, and at least a portion of the appendage may be in contact with two inner cylindrical surfaces of the casing and may be configured to be displaced radially outward in order to maintain contact with the two inner cylindrical surfaces of the casing during radial expansion of the casing.

Embodiments of this disclosure may further provide a method for sealing a turbomachine casing during radial expansion of the turbomachine casing. The method may include disposing a plurality of annular seals within respective annular grooves defined by an outer annular surface of an appendage of a seal apparatus. The seal apparatus may include a first annular body portion from which each of the appendage and a second annular body portion axially extends. The method may also include disposing the sealing apparatus within a central bore of the turbomachine casing. The central bore may be defined by a first inner cylindrical surface, a second cylindrical surface, and a third cylindrical surface of the turbomachine casing. The first inner cylindrical surface, the second cylindrical surface, and the third cylindrical surface may be radially offset from one another. The method may further include sealingly engaging the plurality of seals with the first inner cylindrical surface of the turbomachine casing, and engaging an end portion of the appendage with the second inner cylindrical surface of the turbomachine casing. The method may also include pressurizing an annular cavity defined by an inner annular surface of an appendage of the sealing apparatus and an outer annular surface of the second annular body portion to form a pressure differential across the appendage. The method may further include expanding the appendage radially outward in response to the pressure differential, thereby (i) maintaining contact of the end portion of the appendage with the second inner cylindrical surface of the turbomachine casing, and (ii) maintaining sealing engagement of the plurality of annular seals with the first inner cylindrical surface of the turbomachine casing during the radial expansion of the turbomachine casing.

BRIEF DESCRIPTION OF THE DRAWINGS

Aspects of the present disclosure are best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
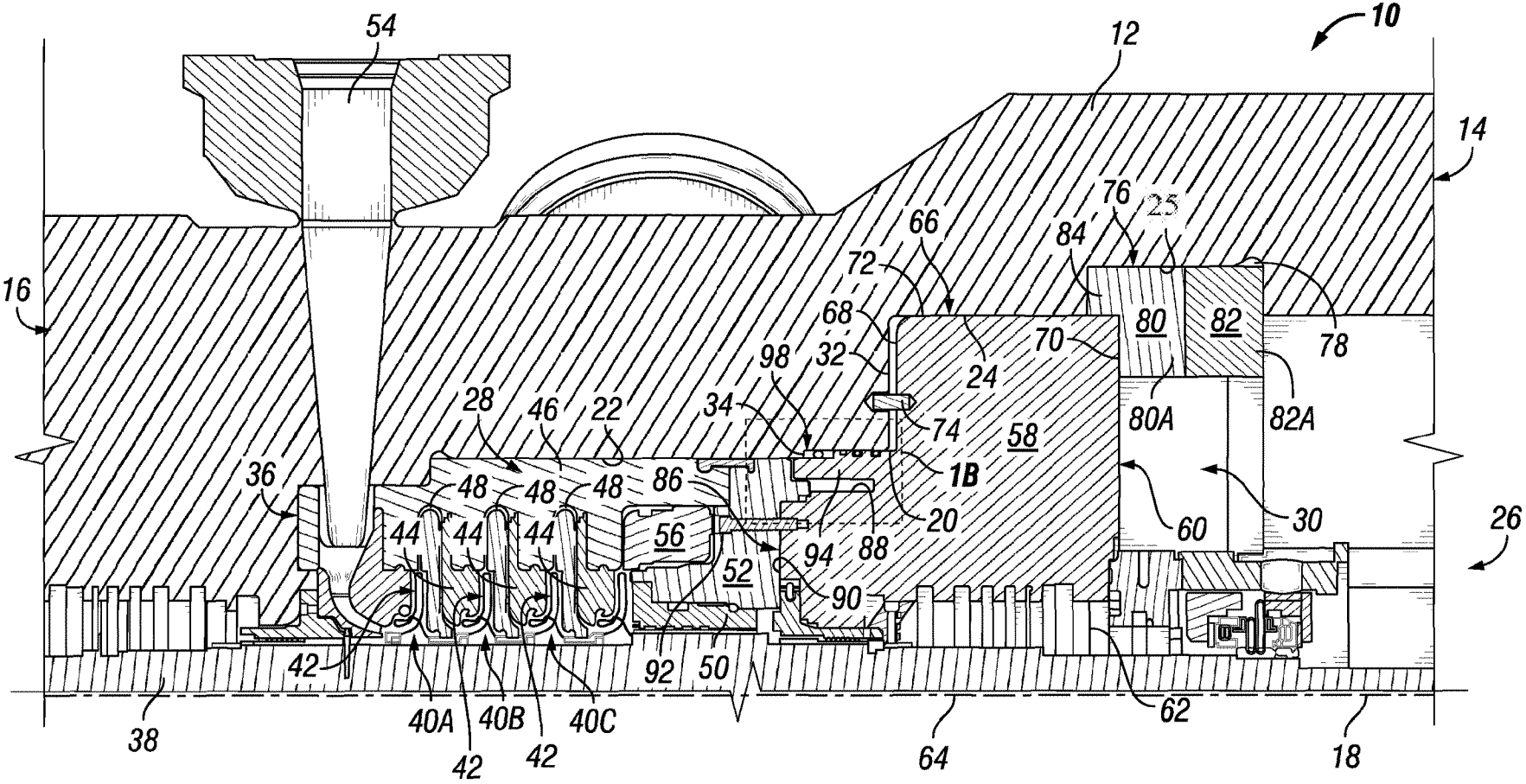
FIG. 1A illustrates a cross-sectional view of an exemplary turbomachine, according to one or more embodiments of the disclosure.

It is to be understood that the following disclosure describes several exemplary embodiments for implementing different features, structures, or functions of the invention. Exemplary embodiments of components, arrangements, and configurations are described below to simplify aspects of the present disclosure; however, these exemplary embodiments are provided merely as examples and are not intended to limit the scope of the invention. Additionally, aspects of the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 1B:
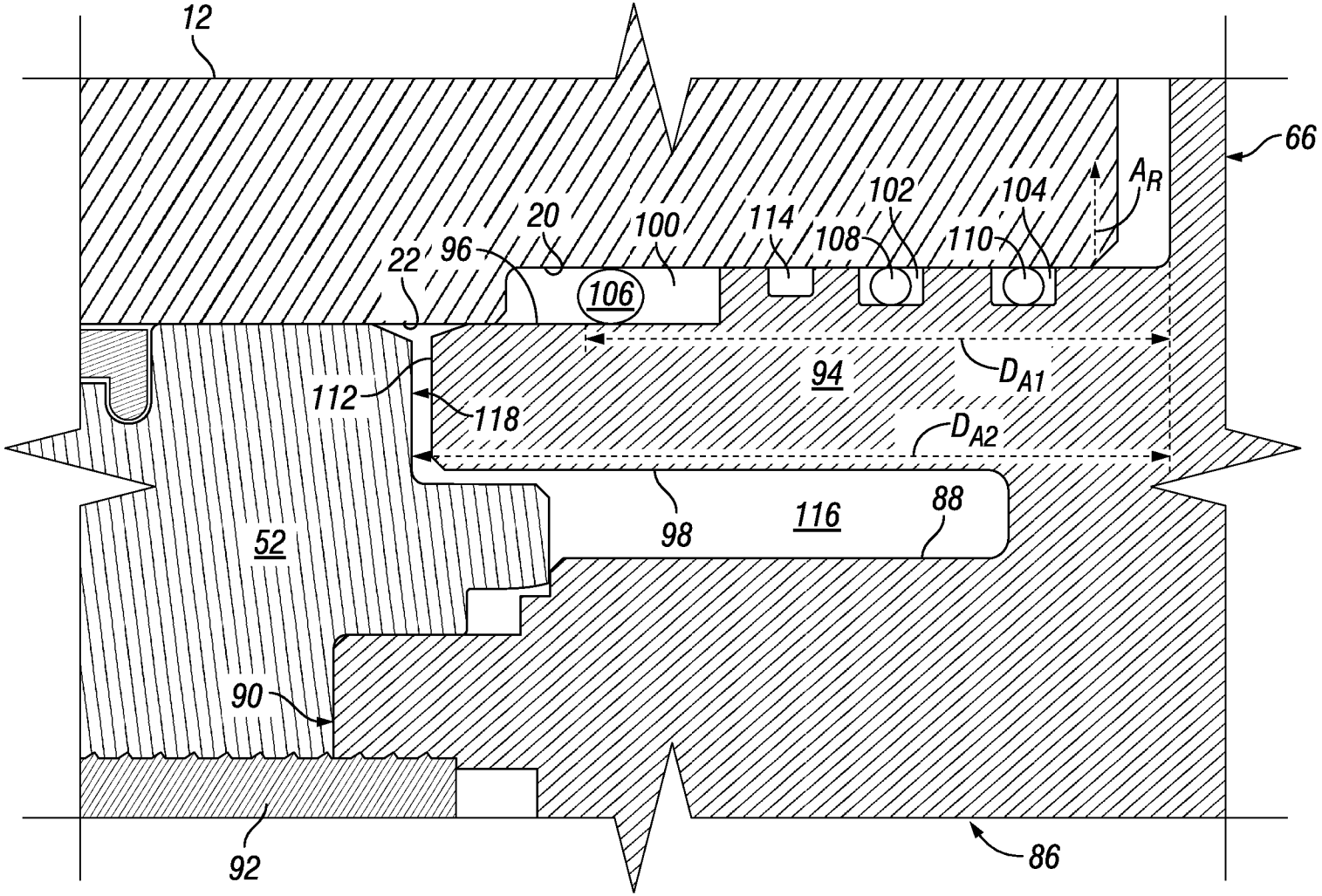
FIG. 1B illustrates an enlarged cross-sectional view of the portion of the turbomachine indicated by the box labeled 1B in FIG. 1A, according to one or more embodiments of the disclosure.

FIG. 1A illustrates a cross-sectional view of an exemplary turbomachine 10, according to one or more embodiments. FIG. 1B illustrates an enlarged cross-sectional view of the portion of the turbomachine 10 indicated by the box labeled 1B in FIG. 1A, according to one or more embodiments of the disclosure. As shown most clearly in FIG. 1A, the turbomachine 10 may be a centrifugal compressor; however, aspects of the present disclosure are not limited thereto, and other illustrative turbomachines 10 may include, but are not limited to, an axial flow compressor, a back-to-back compressor, a rotary separator, and a pump. The turbomachine 10 may be configured to draw a process fluid therein, compress the process fluid, and to discharge the process fluid therefrom at a higher pressure. Accordingly, in some embodiments, the process fluid flowing therethrough and subsequently discharged from the turbomachine 10 may have a pressure of about 10,000 psi (68.9 MPa) or greater. Illustrative process fluids provided to the turbomachine 10 may include, but are not limited to, methane, natural gas, air, oxygen, nitrogen, hydrogen, and carbon dioxide.

The turbomachine 10 may include a casing 12 having opposing axial ends 14, 16 and a central axis 18 extending between the opposing axial ends 14, 16. The casing 12 may include a plurality of inner cylindrical surfaces (four indicated 20, 22, 24, 25) having different internal diameters. The plurality of inner cylindrical surfaces 20, 22, 24, 25 may include a first inner cylindrical surface 20, a second inner cylindrical surface 22, a third inner cylindrical surface 24 and a fourth cylindrical surface 25 having respective internal diameters such that the first inner cylindrical surface 20, the second inner cylindrical surface 22, and third inner cylindrical surface 24 and the fourth cylindrical surface 25 are radially offset from one another.

The first inner cylindrical surface 20, the second inner cylindrical surface 22, the third inner cylindrical surface 24 and the fourth cylindrical surface 25 may define a central bore 26 extending along the central axis 18. A first cylindrical portion of the central bore 26 may be defined by the first inner cylindrical surface 20 and the second inner cylindrical surface 22 and may be referred to as the working chamber 28. A second cylindrical portion of the central bore 26 may be defined by the third inner cylindrical surface 24 and the fourth cylindrical surface 25 and may be referred to as the casing opening 30. As shown in FIG. 1A, the internal diameter of the casing opening 30 may be greater than the internal diameter of the working chamber 28. As such, the central bore 26 may be a stepped bore. For example, an annular wall 32 of the casing 12 may extend radially between the first inner cylindrical surface 20 and the third inner cylindrical surface 24. Additionally, as the first inner cylindrical surface 20 and the second inner cylindrical surface 22 may be radially offset from one another, a shoulder or annular wall 34 may extend radially therebetween.

The working chamber 28 generally houses a modular bundle 36 containing the working components of the turbomachine 10. The casing opening 30 may extend from the axial end 14 of the casing 12 to the working chamber 28, thereby providing a means for insertion or extraction of the modular bundle 36. In one or more embodiments, the modular bundle 36 may include, amongst other working components, a rotary shaft 38 and one or more compression stages (three shown 40A-C), each stage 40A-C including an impeller 42 mounted to the rotatable shaft 38 and at least one stationary diaphragm 44 coupled to a bundle housing 46 and providing outlet and inlet flow passages 48 between each impeller 42. The modular bundle 36 may further include a plurality of seals including a main seal 50 disposed in a sealing relationship with the rotary shaft 38, and a seal carrier 52 provided to support the main seal 50. The casing 12 may further define a radial fluid inlet 54 fluidly coupling a process fluid source or an upstream process component (not shown) with the first compression stage 40A and an outlet chamber or volute 56 fluidly connected with the last compression stage 40C.

The turbomachine 10 may further include a seal apparatus 58 disposed within the central bore 26 and engageable with the casing 12 to close and seal the working chamber 28 from the casing opening 30 such that any leakage of process fluid from the working chamber 28 into the casing opening 30 is substantially reduced or prevented. The seal apparatus 58 may include an annular body 60 defining a center opening 62 through which the rotary shaft 38 may extend. The annular body 60 may have a center axis 64, and as arranged about the rotary shaft 38, the center axis 64 of the annular body 60 and the central axis 18 of the casing 12 may be coaxial. In another embodiment, the annular body 60 may be formed without a center opening 62 and may be used instead to close and seal other types of casing openings 30 (i.e., other than an opening surrounding the rotary shaft 38). In any case, the seal apparatus 58 may be configured or constructed to substantially obstruct or seal the casing opening 30 so as to at least substantially prevent high pressure fluid from flowing out of the working chamber 28 through the casing opening 30. Accordingly, the annular body 60 may have a substantial axial thickness such that the seal apparatus 58 may be capable of resisting relatively high pressure without a substantial deformation or failure of the seal apparatus 58.

The annular body 60 may include a first annular body portion 66 including a first annular sidewall 68, a second annular sidewall 70 axially opposing the first annular sidewall 68, and an outer annular surface 72 extending between the first annular sidewall 68 and the second annular sidewall 70. The sealing apparatus 58 may be disposed within the central bore 26 and between the opposing axial ends 14, 16 of the casing 12 such that the outer annular surface 72 abuts the third inner cylindrical surface 24 and the first annular sidewall 68 abuts or is adjacent the annular wall 32 of the casing 12 extending radially between the first inner cylindrical sidewall 20 and the third inner cylindrical sidewall 24. The first annular sidewall 68 may be coupled to the annular wall 32 via one or more retainers (one shown 74). In one or more embodiments, the first annular sidewall 68 may be coupled to the annular wall 32 via a plurality of retainers 74 circumferentially disposed about the rotary shaft 38. The retainers 74 may be bolts. In other embodiments, the retainers may be dowels, pins, or like components. The retainer(s) 74 may be configured to at least prevent rotational displacement of the annular body 60 about the central axis 18.

The second annular sidewall 70 may abut a retainer 76 disposed in an annular groove 78 defined by the third-fourth inner cylindrical surface 25 at the casing opening 30. The retainer 76 may include two rings 80, 82, the first or annular shear ring 80 having an axial lip 84 disposed or disposable between a portion of the first annular body portion 66 and the annular groove 78. Each shear ring 80, 82 may be formed of a plurality of arcuate segments 80A, 82A (only one each shown), spaced circumferentially about the central axis 18. The annular shear rings 80, 82 may be configured to retain the seal apparatus 58 within the central bore 26 during operation of the turbomachine 10. During extraction of the modular bundle 36, a sufficient axial force may be applied to the modular bundle 36 to shear the annular shear rings 80, 82 and axially slide the seal apparatus 58 and the modular bundle 36 from the turbomachine 10.

The annular body 60 may also include a second annular body portion 86 extending axially from the first annular body portion 66 and having an outer annular surface 88 radially offset from the outer annular surface 72 of the first annular body portion 66. The second annular body portion 86 may be disposed in the working chamber 28 of the central bore 26 adjacent the seal carrier 52. In one or more embodiments, an axial end 90 of the second annular body portion 86 may be coupled to the seal carrier 52 via one or more mechanical fasteners (one shown 92). In one or more embodiments, the axial end 90 of the second annular body portion 86 may be coupled to the seal carrier 52 via a plurality of mechanical fasteners 92 circumferentially disposed about the rotary shaft 38. The mechanical fasteners 92 may be bolts, such as, for example, tie bolts. In other embodiments, the mechanical fasteners 92 may be dowels, pins, or like components.

As seen most clearly in FIG. 1B, the annular body 60 may further include an appendage 94 extending axially from the first annular body portion 66 and having an outer annular surface 96 and an inner annular surface 98. The outer annular surface of the appendage 94 may define a plurality of annular grooves 100, 102, 104. A plurality of annular seals 106, 108, 110 may be disposed within the respective annular grooves 100, 102, 104. As disposed within the annular grooves 100, 102, 104, a portion of each of the annular seals 106, 108, 110 may extend radially from the respective annular groove 100, 102, 104 and engage the first inner cylindrical surface 20 of the casing 12 in order to provide a seal between the appendage 94 and the first inner cylindrical surface 20. The annular seals 106, 108, 110 may be constructed from a compressible polymer material in one or more embodiments. In one example, the annular seals 106, 108, 110 may be O-rings. In other embodiments, the annular seals 106, 108, 110 may be constructed from a compressible non-polymer material.

The plurality of annular seals 106, 108, 110 may include a primary annular seal 106 and one or more secondary annular seals (two shown 108 and 110). The primary annular seal 106 may be disposed in the annular groove 100 proximal an end portion 112 of the appendage 94 distal the first annular body portion 66. As disposed in the central bore 26, the end portion 112 of the appendage 94 may engage or contact the second inner cylindrical surface 22 of the casing 12. In at least one aspect of the present invention, the end portion 112 is used to locate the appendage 94 relative to the second inner cylindrical surface 22.

As arranged, the primary annular seal 106 may be subject to a maximum pressure of the process fluid flowing through the turbomachine 10. Accordingly, the primary annular seal 106 and the respective annular groove 100 in which the primary annular seal 106 is disposed may be greater in size than the secondary seal(s) 108, 110 and the respective annular grooves 102, 104 in which the secondary annular seals 108, 110 are disposed. For example, in one or more embodiments, the primary annular seal 106 may have a greater external diameter than an external diameter of each of the secondary annular seals 108, 110. Accordingly, as arranged, each of the secondary annular seals 108, 110 may see a pressure equal to or less than the maximum pressure seen by the primary annular seal 106. In one or more embodiments, the secondary seals 108, 110 may be "step down" seals in that the secondary seal 110 may see a lower pressure than the previous secondary annular seal 108. In other embodiments, the secondary annular seals 108, 110 may be utilized as back-up seals in case of failure of the primary annular seal 106.

The outer annular surface 96 of the appendage 94 and the first inner cylindrical surface 20 of the casing 12 may further define a port 114 disposed between adjacent annular seals 106, 108 or 108, 110. In one or more embodiments, the port 114 may be disposed between the primary seal 106 and an adjacent secondary seal 108. In another embodiment, the port 114 may be disposed between adjacent secondary seals 108, 110. The port 114 may be fluidly coupled to a lower pressure environment within the casing 12 of the turbomachine 10, or in other embodiments, the port 114 may be fluidly coupled to a lower pressure environment external of the casing 12 of the turbomachine 10 via one or more flowpaths defined in the casing 12. For example, the port 114 may be fluidly coupled to the atmosphere external of the casing 12, a flare, an inlet of another process component, or any other suitable pressure sink. In another example, the port 114 may be fluidly coupled to a stage 40A-C in the working chamber 28. As configured, the port 114 may be configured as a component of a leak detection system (not shown) for the annular seals 106, 108, 110. In other embodiments, the port 114 may be configured as a vent for leakage of process fluid within the turbomachine 10.

The inner annular surface 98 of the appendage 94 and the outer annular surface 88 of the second annular body portion 86 may define an annular cavity 116 therebetween. The annular cavity 116 may be bounded axially by the seal carrier 52 and the first annular body portion 66. The annular cavity 116 may be fluidly coupled with at least one stage 40A-C. In one or more embodiments, the annular cavity 116 may be fluidly coupled with the last stage 40*c* such that a pressurized process fluid may be directed to the annular cavity 116. The annular cavity 116 may be configured to receive the pressurized process fluid therein, thereby creating a pressure differential across the appendage 94. Further, as the process fluid is being pressurized in the turbomachine 10, the casing 12 of the turbomachine 10 may radially expand in response to the generation of the pressurized process fluid. At least a portion of the appendage 94 is configured to be displaced radially outward due to the pressure differential thereacross in order to maintain contact with the first inner cylindrical surface 20 and the second inner cylindrical surface 22 of the casing 12 during radial expansion of the casing 12. As the appendage 94 is capable of radial movement outward, the appendage 94 may maintain sealing engagement of the annular seals 106, 108, 110 with the first inner cylindrical surface 20 of the casing 12 during radial expansion of the casing 12. Contact between the end portion 112 of the appendage 94 and the second inner cylindrical surface 22 of the casing 12 serves to stop outward radial movement of the appendage 94 to ensure dimensional tolerances suitable for providing a seal between the annular seals 106, 108, 100 and associated annular grooves 100, 102, 104 and the first inner cylindrical surface 20 are maintained.

The primary annular seal 106 may be disposed in the annular groove 100 at a first axial distance $D_{A1}$ from the first annular body portion 66. An end portion 118 of the annular cavity 116 distal the first annular body portion 66 may be at a second axial distance $D_{A2}$ from the first annular body portion 66. Accordingly, in one or more embodiments, the second axial distance $D_{A2}$ may be greater than the first axial distance $D_{A1}$.

With the above structure, embodiments of the seal apparatus 58 are clearly advantageous compared with previously known fluid machine casing closure devices. During operation of the turbomachine 10, the working chamber 28 may contain high-pressure process fluid, which often exerts a pressure on the casing 12 sufficient to cause the casing 12, including the plurality of inner cylindrical surfaces 20, 22, 24, 25 to expand radially outwardly, as indicated by arrow $A_R$ in FIG. 1B. As such, the inner cylindrical surfaces 20, 22, 24, 25 may be displaced radially outward from the appendage 94. By providing a portion of the pressurized process fluid to the annular cavity 116, the appendage 94 of the sealing apparatus 58 is configured to move radially outward with the radial expansion of the casing 12, thereby maintaining sealing engagement with the inner cylindrical surface 22 of the casing 12, thereby substantially eliminating any space between the appendage 94 and the inner cylindrical surfaces 20, 22, thus acting to prevent leakage of fluid from the working chamber 28.

Figure 2:
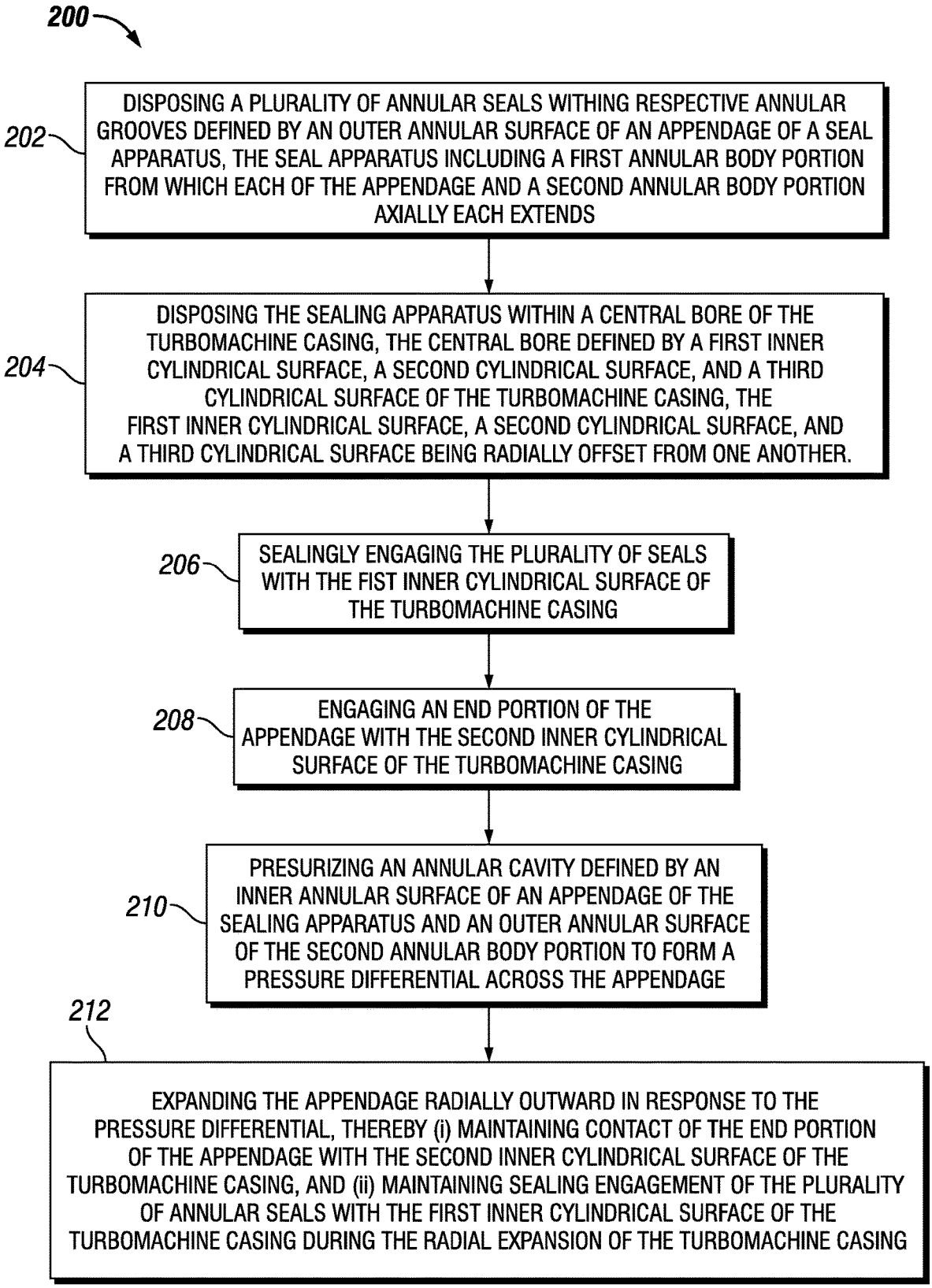
FIG. 2 illustrates a flowchart depicting a method for sealing a turbomachine casing during radial expansion of the turbomachine casing, according to one or more embodiments disclosed.

Turning now to FIG. 2, FIG. 2 illustrates a flowchart depicting a method 200 for sealing a turbomachine casing during radial expansion of the turbomachine casing, according to one or more embodiments disclosed. The method may include disposing a plurality of annular seals within respective annular grooves defined by an outer annular surface of an appendage of a seal apparatus, as at 202. The seal apparatus may include a first annular body portion from which the appendage and a second annular body portion axially each extend. The method 200 may also include disposing the sealing apparatus within a central bore of the turbomachine casing, as at 204. The central bore may be defined by a first inner cylindrical surface, a second cylindrical surface, and a third cylindrical surface of the turbomachine casing. The first inner cylindrical surface, a second cylindrical surface, and a third cylindrical surface may be radially offset from one another.

The method 200 may further include sealingly engaging the plurality of seals with the first inner cylindrical surface of the turbomachine casing, as at 206, and engaging an end portion of the appendage with the second inner cylindrical surface of the turbomachine casing, as at 208. The method 200 may also include pressurizing an annular cavity defined by an inner annular surface of an appendage of the sealing apparatus and an outer annular surface of the second annular body portion to form a pressure differential across the appendage, as at 210. The method 200 may further include expanding the appendage radially outward in response to the pressure differential, thereby (i) maintaining contact of the end portion of the appendage with the second inner cylindrical surface of the turbomachine casing, and (ii) maintaining sealing engagement of the plurality of annular seals with the first inner cylindrical surface of the turbomachine casing during the radial expansion of the turbomachine casing.

The method 200 may include further include drawing a process fluid into one or more impellers coupled to a rotating shaft extending along a center axis of the turbomachine casing to form a pressurized process fluid. The method 200 may further include fluidly coupling a port defined by the first inner cylindrical surface of the turbomachine casing and the outer annular surface of the appendage with a lower pressure environment. The port may be configured to vent a leakage of the pressurized process fluid across one or more annular seals of the plurality of annular seals. As provided in the method 200, pressurizing the annular cavity may further include feeding a portion of the pressurized process fluid to the annular cavity. Further, the third inner cylindrical surface may define an open end of the turbomachine casing, and an annular face of the first annular body portion may abut an annular wall extending radially between the first inner cylindrical surface and the third inner cylindrical surface.

It should be appreciated that all numerical values and ranges disclosed herein are approximate valves and ranges, whether "about" is used in conjunction therewith. It should also be appreciated that the term "about," as used herein, in conjunction with a numeral refers to a value that is +/−5% (inclusive) of that numeral, +/−10% (inclusive) of that numeral, or +/−15% (inclusive) of that numeral. It should further be appreciated that when a numerical range is disclosed herein, any numerical value falling within the range is also specifically disclosed.

The foregoing has outlined features of several embodiments so that those skilled in the art may better understand aspects of the present disclosure. Those skilled in the art should appreciate that they may readily use aspects of the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of aspects of the present disclosure, and that they may make various changes, substitutions and alterations herein without departing from the spirit and scope of aspects of the present disclosure.

I claim:

1. A seal apparatus for a casing of a turbomachine, comprising:

an annular body having a center axis and defining a central opening extending along the center axis, the annular body further comprising a first annular body portion comprising a first annular sidewall, a second annular sidewall axially opposing the first annular sidewall, and an outer annular surface extending between the first annular sidewall and the second annular sidewall;

a second annular body portion extending axially from the first annular body portion and having an outer annular surface radially offset from the outer annular surface of the first annular body portion;

an appendage extending axially from the first annular body portion and having an outer annular surface and an inner annular surface, the inner annular surface of the appendage and the outer annular surface of the second annular body portion defining an annular cavity therebetween, and at least a portion of the appendage is configured to be displaced radially outward in order to maintain contact with a first inner cylindrical surface of the casing and a second inner cylindrical surface of the casing during radial expansion of the casing; and a plurality of annular seals disposed in respective annular grooves defined by the outer annular surface of the appendage, at least a portion of each of the plurality of annular seals extending radially outward from the respective annular groove and configured to sealingly engage the first inner annular surface of the casing, wherein the outer annular surface of the appendage further defines a port disposed between adjacent annular seals and configured to be fluidly coupled to a lower pressure environment.

2. The seal apparatus of claim 1, wherein the adjacent seals are a primary seal and a secondary seal, the primary seal configured to be subjected to a maximum pressure in the casing generated by the turbomachine, and the secondary seal configured to be subjected to a pressure equal to or less than the maximum pressure in the casing generated by the turbomachine.

3. The seal apparatus of claim 2, wherein the primary seal is disposed on the appendage at a first axial distance from the first annular body portion, and an end portion of the annular cavity distal the first annular body portion is at a second axial distance from the first annular body portion, the second axial distance being greater than the first axial distance.

4. A turbomachine having a casing comprising:

a center axis;

a first end and a second end axially opposing the first end;

a plurality of inner cylindrical surfaces radially offset from one another and defining a first portion and a second portion of a central bore, the second portion extending from the first portion to the second end of the casing;

a rotary shaft;

one or more rotating components coupled to the rotary shaft, the one or more rotating components disposed within the first portion of the central bore and configured to pressurize a process fluid;

a seal apparatus disposed within the central bore and configured to substantially reduce or prevent the process fluid pressurized in the first portion from exiting the second end of the casing, the seal apparatus comprising:

a first annular body portion disposed within the second portion of the central bore;

a second annular body portion extending axially from the first annular body portion and having an outer annular surface; and an appendage extending axially from the first annular body portion and having an outer annular surface and an inner annular surface, the inner annular surface of the appendage and the outer annular surface of the second annular body portion defining an annular cavity therebetween, and at least a portion of the appendage is in contact with two inner cylindrical surfaces of the casing and is configured to be displaced radially outward to maintain contact with the two inner cylindrical surfaces of the casing during radial expansion of the casing, wherein the plurality of inner cylindrical surfaces comprises:

a first inner cylindrical surface and a second inner cylindrical surface defining the first portion of the casing, and a third inner cylindrical surface defining the second portion of the casing; and wherein the casing further comprises:

a first annular wall extending radially between the first inner cylindrical surface and the third inner cylindrical surface, and a second annular wall extending radially between the first inner cylindrical surface and the second inner cylindrical surface;

a plurality of annular seals disposed in respective annular grooves defined by the outer annular surface of the appendage, at least a portion of each of the plurality of annular seals extending radially outward from the respective annular groove in sealing engagement with the first inner cylindrical surface of the casing, wherein the outer annular surface of the appendage further defines a port disposed between adjacent annular seals, and the turbomachine further being configured to fluidly couple the port with a lower pressure environment.

5. The turbomachine of claim 4, wherein the adjacent seals are a primary seal and a secondary seal, the primary seal being subjected to a maximum pressure in the casing generated by the turbomachine, and the secondary seal being subjected to a pressure equal to or less than the maximum pressure in the casing generated by the turbomachine.

6. The turbomachine of claim 5, wherein the primary seal is disposed on the appendage at a first axial distance from the first annular body portion, and an end portion of the annular cavity distal the first annular body portion is at a second axial distance from the first annular body portion, the second axial distance being greater than the first axial distance.

7. The turbomachine of claim 6, wherein the appendage has an end portion distal the first annular body portion, the end portion contacting the second inner cylindrical surface of the casing.

8. The turbomachine of claim 4, wherein the rotary shaft extends along the central axis and through a center opening defined by the seal apparatus.

9. The turbomachine of claim 4, wherein the one or more rotating components include one or more impellers, each impeller being part of a respective stage of compression, and the annular cavity being fluidly coupled to a last stage of compression of the turbomachine.

10. The turbomachine of claim 4, further comprising a shear ring disposed within an annular groove defined by the third inner cylindrical surface of the casing and configured to retain the seal apparatus within the central bore.

11. A method for sealing a turbomachine casing during radial expansion of the turbomachine casing, comprising:

disposing a plurality of annular seals within respective annular grooves defined by an outer annular surface of an appendage of a seal apparatus, the seal apparatus including a first annular body portion from which each of the appendage and a second annular body portion axially extends;

disposing the seal apparatus within a central bore of the turbomachine casing, the central bore defined by a first inner cylindrical surface, a second cylindrical surface, and a third cylindrical surface of the turbomachine casing wherein the first inner cylindrical surface, the second cylindrical surface, and the third cylindrical surface are radially offset from one another;

sealingly engaging the plurality of seals with the first inner cylindrical surface of the turbomachine casing;

engaging an end portion of the appendage with the second inner cylindrical surface of the turbomachine casing;

pressurizing an annular cavity defined by an inner annular surface of an appendage of the seal apparatus and an outer annular surface of the second annular body portion to form a pressure differential across the appendage;

expanding the appendage radially outward in response to the pressure differential, thereby (i) maintaining contact of the end portion of the appendage with the second inner cylindrical surface of the turbomachine casing, and (ii) maintaining sealing engagement of the plurality of annular seals with the first inner cylindrical surface of the turbomachine casing during the radial expansion of the turbomachine casing;

drawing a process fluid into one or more impellers coupled to a rotating shaft extending along a center axis of the turbomachine casing to form a pressurized process fluid; and fluidly coupling a port defined by the first inner cylindrical surface of the turbomachine casing and the outer annular surface of the appendage with a lower pressure environment, wherein the port is configured to vent a leakage of the pressurized process fluid across one or more annular seals of the plurality of annular seals to the lower pressure environment.

12. The method of claim 11, wherein pressurizing the annular cavity further comprises feeding a portion of the pressurized process fluid to the annular cavity.

13. The method of claim 11, wherein the third inner cylindrical surface defines an open end of the turbomachine casing, and an annular face of the first annular body portion abuts an annular wall extending radially between the first inner cylindrical surface and the third inner cylindrical surface.

* * * * *